United States Patent [19]

Vickio

[11] 4,434,687

[45] Mar. 6, 1984

[54] DAMAGED SCREW REMOVER

[75] Inventor: Anthony N. Vickio, Montour Falls, N.Y.

[73] Assignee: Vi-Tek Designs, Inc., Montour Falls, N.Y.

[21] Appl. No.: 438,174

[22] Filed: Nov. 1, 1982

[51] Int. Cl.[3] ..... B25B 15/00

[52] U.S. Cl. ..... 81/441; 81/451

[58] Field of Search ..... 81/451, 441, 436

[56] References Cited

U.S. PATENT DOCUMENTS

| | | | |
|---|---|---|---|
| 685,197 | 10/1901 | Barnes | 81/441 |
| 1,055,031 | 3/1913 | Groos | 81/436 |
| 1,547,944 | 7/1925 | Murphree . | |
| 1,761,156 | 6/1930 | Rosan | 81/436 |
| 2,684,094 | 7/1954 | Lissy | 81/436 |
| 2,750,821 | 7/1956 | Hilsinger . | |
| 2,815,054 | 12/1957 | Cummaro . | |
| 3,888,144 | 6/1975 | Parsons | 81/436 |
| 3,891,017 | 6/1975 | Iskra | 81/436 |
| 4,016,912 | 4/1977 | St-Amour | 145/50 A |
| 4,026,338 | 5/1977 | Goebel | 81/441 |
| 4,190,091 | 2/1980 | Colognori | 81/436 |

FOREIGN PATENT DOCUMENTS

| | | | |
|---|---|---|---|
| 72601 | 6/1951 | Denmark | 81/451 |
| 803962 | 4/1951 | Fed. Rep. of Germany | 81/451 |
| 966272 | 10/1950 | France | 81/451 |
| 766 | of 1914 | United Kingdom | 81/436 |

*Primary Examiner*—Frederick R. Schmidt
*Assistant Examiner*—J. T. Zatarga
*Attorney, Agent, or Firm*—Cifelli, Frederick & Tully

[57] ABSTRACT

A damaged screw remover comprises a handle and a shank terminating in a relatively wide blade, all resembling a standard screwdriver, the blade having a modified working end adapting it for engaging and rotating damaged screws. The working end includes an axially-disposed blunt tip of square cross-section, with two surfaces coplanar with the blade faces. Flanking the tip are bevelled end surfaces, each disposed at an acute angle (45°) with respect to the blade faces, to form sharp leading edges which dig into the screw, providing good engagement as the screw is removed.

10 Claims, 5 Drawing Figures

DAMAGED SCREW REMOVER

BACKGROUND OF INVENTION

This invention relates to damaged screw removers.

Screws and bolts are very common holding devices, and are often provided with a round head having a transverse slot of generally rectangular cross-section wherein they may be driven by a standard screwdriver. Such a standard screwdriver comprises a blade which has flat sides and a flat bottom, a shank and a handle. The blade fits into the slot of the screw for turning the screw either clockwise or counterclockwise for tightening or removing it. If the screw is exceptionally difficult to turn, or if the screwdriver is worn, damage to the screw slot can occur. If such damage, in the form of deforming the configuration of the slot, occurs when trying to remove the screw, the screw will no longer accept and be turned by a standard screwdriver, presenting a problem in removing the screw.

Barnes U.S. Pat. No. 685,197 discloses a screwdriver which is modified for use with screws having damaged or worn screw slots. The screwdriver of the Barnes Patent has a modified blade including projections extending laterally in opposite directions from the blade, at the lower or working end thereof. The projections are sufficiently sharp to cause them to bite into the wall of the screwhead slot and thereby prevent the tool from slipping out of the slot. The orientation of the projections is provided according to whether the tool is to be used in driving or removing damaged screws. A problem with the Barnes device is that it is sometimes difficult to seat it in the screw slot and establish the biting relationship with the worn or damaged screwhead, and to do so without damaging the device.

Another prior art device is described in Goebel U.S. Pat. No. 4,026,338, which discloses a tool for removing one-way screws. A typical one-way screw has bevelled portions replacing the standard screw slot wall at the areas of engagement for removing the screw, wherein the standard screwdriver will not engage with the screw for removing it. The tool provided for removing such a screw includes a modified blade having pointed, angled projections laterally displaced from the axis of the blade. The projections may be driven into the head of the one-way screw and allow the screw to be removed by turning the tool in the same manner as an ordinary screwdriver.

Other prior art patents include Murphree U.S. Pat. No. 1,547,944, which discloses a broken stud bolt remover, which is essentially a shaped bit adapted to be forced-fit into a guide hole drilled in a broken stud, and Hilsinger U.S. Pat. No. 2,750,821 which shows a damaged screw remover comprising a plurality of spaced-apart points which are driven into a damaged screwhead for engaging it and thereby turning it for removing the screw. Cummaro U.S. Pat. No. 2,815,054 shows a removal tool for damaged Philips-head screws. St-Amour U.S. Pat. No. 4,016,912 shows a modified screwdriver blade for engaging worn screw slots wherein the vertical edges of the blade are enlarged.

SUMMARY OF INVENTION

The damaged screw remover according to the invention herein comprises a handle, a shank and a blade, wherein the working end of the blade is adapted to engage and rotate screws having worn or damaged transverse slots. For this purpose, the working end of the blade has a tip projecting along the rotational axis of the damaged screw remover, the projecting tip preferably having a square cross-section with two sides coplanar with the flat blade faces. The projection may have either a flat or pointed end. The blade end surfaces flanking the projecting tip and joining the two blade faces are bevelled in the direction of counterclockwise rotation. More praticularly, these bottom blade surfaces and the flat blade faces are disposed at an acute angle pointing in the direction of counterclockwise rotation, and meet at a sharp edge.

The damaged screw remover is utilized by placing it on the head of a damaged screw, with the tip at the approximate center of the slot and the blade aligned with the damaged or worn screw slot. One or more blows are applied to the free end handle, which sets the tip and the sharp edges of the blade into the damaged screw head. Upon applying steady axial pressure and turning the damaged screw remover in a counterclockwise direction, the sharp edges hold engagement with the damaged screw slot, thereby engaging the screw and rotating it for removal. The square point of the damaged screw remover prevents the blade from sliding off engagement with the damaged screwhead, and also assists in rotating the damaged screw.

Accordingly, it is the principal object of the invention to provide an improved damaged screw remover.

It is an additional object of the invention to provide a damaged screw remover which provides for good engagement with damaged screws.

It is a further object of the invention to provide a damaged screw remover which is rugged and resists damage to itself in use.

Other and more specific objects and features of the invention will in part be obvious and will in part appear from a perusal of the following description of the preferred embodiment and the claims, taken together with the drawings.

DRAWINGS

The same reference numerals refer to the same elements throughout the various figures.

DESCRIPTION OF PREFERRED EMBODIMENT

Figure 1:
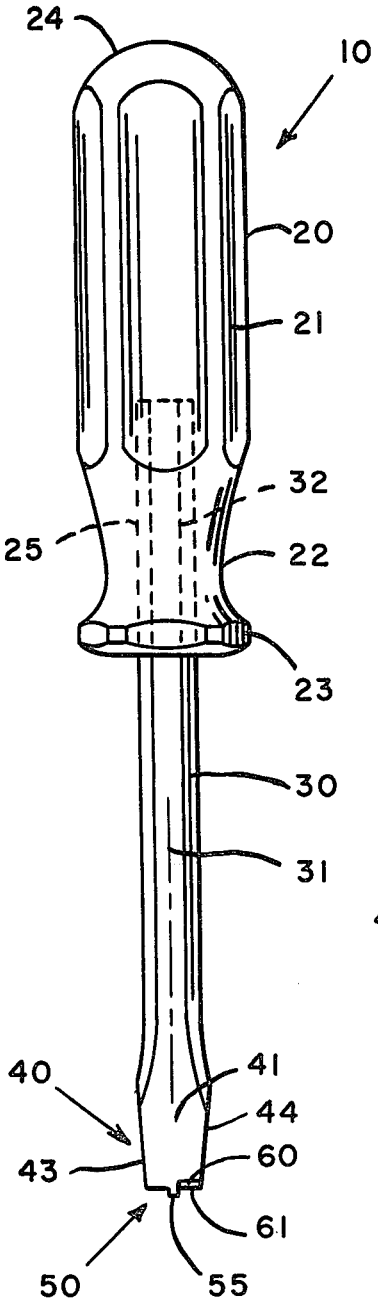
FIG. 1 is a front elevation view of a damaged screw remover according to the invention herein.
Figure 2:
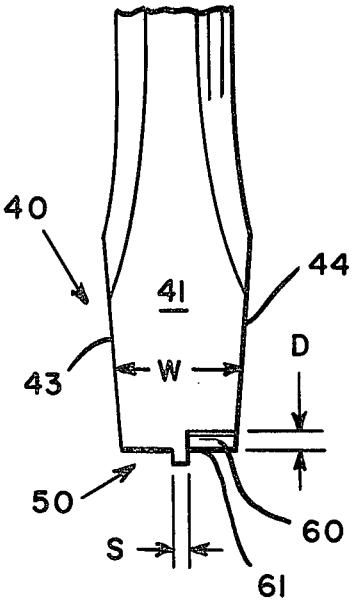
FIG. 2 is an enlarged front elevation view of the blade of the damaged screw remover of FIG. 1.
Figure 3:
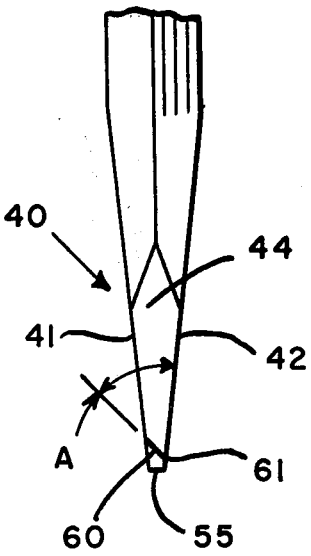
FIG. 3 is an enlarged side elevation view of the blade of the damaged screw remover of FIG. 1.
Figure 4:
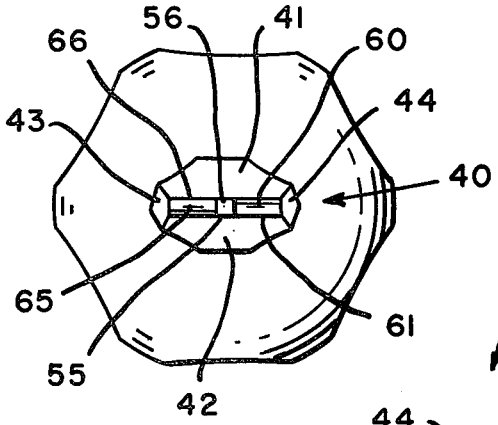
FIG. 4 is a blade end view of the damaged screw remover of FIG. 1.
Figure 5:
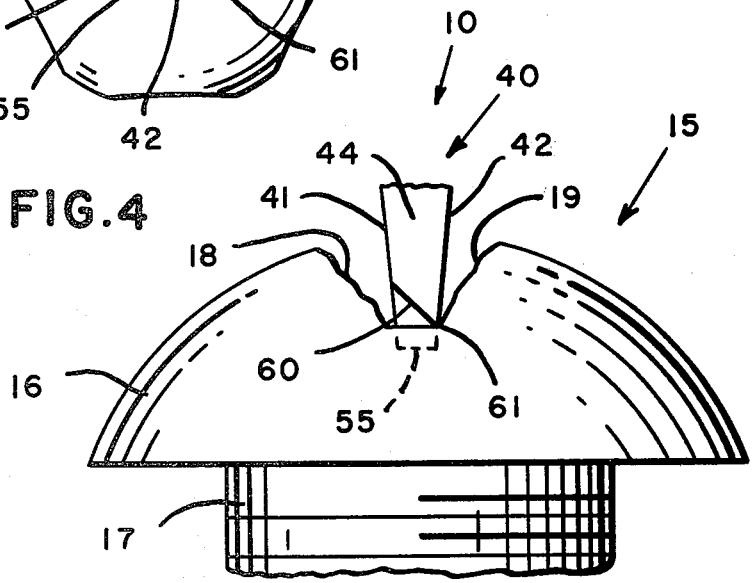
FIG. 5 is an enlarged side elevation view of the blade of the damaged screw remover of FIG. 1 engaging a damaged screw.

Various views of a damaged screw remover 10 according to the invention herein are shown in FIGS. 1–4, and a damaged screw remover 10 is shown applied to a damaged screw 15 in FIG. 5. The damaged screw remover 10 generally comprises a handle 20, a shank 30 and a blade 40. The configuration of the blade 40 distinguishes the damaged screw remover from a standard blade screwdriver and adapts the damaged screw remover for engaging with and removing damaged screws.

The handle 20 may be a conventional screwdriver handle, being molded of a high strength plastic material capable of withstanding impact. The handle 20 has an upper portion 21 of hexagonal or other shape which provides a good grip in rotating the damaged screw remover 10, a reduced diameter neck portion 22 which usually accommodates the index finger and thumb of the user's hand, and a flange 23, which serves to keep the user's hand from sliding off the handle. The handle has an axially disposed cavity 25 for receiving and retaining the upper end 31 of the shank or shaft 30, as is well-known in tool art. In the embodiment shown, the shank 30 is hexagonal when viewed in cross-section, which simplifies the non-rotational engagement between the handle and shank, although a round shank could also be used and means are known for the suitable mounting of a round shank to the handle. The shank 30 is fabricated of a good grade of steel, and has a longitudinal axis indicated at 31 which is also the axis of rotation of the entire damaged screw remover 10, the handle 20 being aligned with or adapted to rotate about the axis of rotation 31.

The blade 40 is integrally formed with the shank 30 at the end opposite the handle 20. The blade 40 comprises two generally opposed faces 41 and 42 joined by sides 43 and 44 and by the working end 50, which distinguishes the blade 40 from that of a standard screwdriver and adapts the blade 40 for engagement with damaged screws. The generally opposed faces 41 and 42 may taper toward or converge as they approach the working end 50, as best seen in FIG. 3 and as is common in standard screwdrivers, and the term "generally opposed" is intended to encompass such configuration.

The working end 50 includes an axially-disposed projecting tip 55 flanked by radially-disposed bevelled end surfaces 60 and 65, end surface 65 being seen only in FIG. 4. The tip 55 is preferably rectangular or square in cross-section, as seen in FIG. 4, and two of its axial surfaces may be coplanar extensions of the blade faces 41 and 42. The end 56 of the projecting tip 55 may be flat and blunt, although a point could be provided if desired. In one typically sized damaged screw remover, the overall blade width W may be approximately three-eighths of an inch wide, the projecting tip 55 may have a depth D of approximately one-sixteenth of an inch, and the tip may be approximately three-sixteenths of an inch wide on each side S.

The radially-disposed end surface 60 is bevelled to form an acute angle A with respect to face 41, wherein the surface 60 joins the face of 41 at a sharp edge 61 which is the leading edge when the damaged screw remover 10 is rotated counterclockwise about its axis of rotation 31. Similarly, the other end surface 65 is disposed at an acute angle with respect to the blade face 42, thereby joining blade face 42 at a sharp edge 66 which is also the leading edge upon counterclockwise rotation of the damaged screw remover 10. The angle A is preferably approximately 45° although angles within the range of 30 to 60 degrees are useful.

With respect to FIG. 5, the working end 50 of the blade 40 is shown engaged with a damaged screw 15. The damaged screw 15 comprises a screw head 16 and a threaded shank 17. The head 16 has a transverse slot 18 formed therein for receiving a standard screwdriver, the walls of which are provided flat, smooth and configured for engagement by the standard screwdriver. However, in many instances the walls of the transverse screw slot can become damaged, such as by using a worn screwdriver, incorrectly using the screwdriver, or the like, and such damage often takes the form of spreading and/or bevelling the slot as indicated at 19.

The damaged screw remover is utilized by placing the working end 50 of the blade 40 in the slot 18 and impacting the free end 24 of the handle. This sets the projecting tip 55 into the screwhead, often by cutting downwardly in the damaged portion. This provides for good engagement between the blade of the damaged screw remover and the damaged screwhead, and upon exertion of axial pressure to maintain the good engagement, the damaged screw remover is rotated counterclockwise to remove the damaged screw.

Accordingly, there has been described a damaged screw remover 10 which admirably achieves the objects of the invention herein. It will be appreciated by those skilled in the art that various changes may be made without departing from the spirit and scope of the invention, which is limited only by the following claims.

I claim:

1. A damaged screw remover comprising a shank having a longitudinal axis of rotation, a handle mounted to said shank, and a blade integral with the shank opposite the handle, the blade having two generally opposed faces joined together by sides and a working end, the working end including an axially-disposed projecting tip for driving into a damaged screw slot and setting the same therein by cutting into the damaged screw slot and radially-disposed end surfaces flanking the tip, each end surface deployed at an acute angle with respect to one of the opposed faces, wherein the end surfaces join the faces at sharp edges which are the leading edges when the damaged screw remover is rotated couterclockwise.

2. A damaged screw remover as defined in claim 1 wherein the projecting tip is polygonal.

3. A damaged screw remover as defined in claim 1 wherein the projecting tip is rectangular and has two of its surfaces coplanar with, respectively, the two opposed blade faces.

4. A damaged screw remover as defined in claim 3 wherein the projecting tip has a flat end surface.

5. A damaged screw remover as defined in claim 4 wherein each radially-disposed end surfaces is deployed at an angle in the range of 30–60 degrees with respect to the blade face with which it forms a leading sharp edge in counterclockwise rotation.

6. A damaged screw remover as defined in claim 5 wherein the angle is about 45 degrees.

7. A damaged screw remover as defined in claim 3 wherein each radially-disposed end surface is deployed at an angle in the range of 30–60 degrees with respect to the blade face with which it forms a leading sharp edge in counterclockwise rotation.

8. A damaged screw remover as defined in claim 7 wherein the angle is about 45 degrees.

9. A damaged screw remover as defined in claim 1 wherein each radially-disposed end surfaces is deployed at an angle in the range of 30–60 degrees with respect to the blade face with which it forms a leading sharp edge in counterclockwise rotation.

10. A damaged screw remover as defined in claim 9 wherein the angle is about 45 degrees.

* * * * *